United States Patent [19]

Higgins

[11] 4,397,900

[45] Aug. 9, 1983

[54] MAGNETIC CARPET TILE

[75] Inventor: Kenneth B. Higgins, LaGrange, Ga.

[73] Assignee: Milliken Research Corporation, Spartanburg, S.C.

[21] Appl. No.: 332,858

[22] Filed: Dec. 21, 1981

[51] Int. Cl.[3] ..... B32B 3/02

[52] U.S. Cl. ..... 428/95; 156/72; 156/250; 156/285; 156/298; 156/273.3; 428/900

[58] Field of Search ..... 428/49, 900, 95; 156/72, 250, 272, 285, 298

[56] References Cited

U.S. PATENT DOCUMENTS

| | | | |
|---|---|---|---|
| 3,120,083 | 2/1964 | Dahlberg et al. | 50/413 |
| 3,158,518 | 11/1964 | Kessler | 156/72 |
| 3,341,996 | 9/1967 | Jones et al. | 52/309 |
| 3,665,355 | 5/1972 | Sasaki et al. | 428/900 |
| 3,695,987 | 10/1972 | Wisotzky et al. | 161/67 |
| 3,702,797 | 11/1972 | Cochran | 161/66 |
| 3,713,960 | 1/1973 | Cochran | 161/66 |
| 3,728,204 | 4/1973 | Cochran | 161/66 |
| 3,741,854 | 6/1973 | De Goria | 161/67 |
| 3,746,573 | 7/1973 | Helta et al. | 117/139.5 |
| 3,819,463 | 6/1974 | Ervin et al. | 161/64 |
| 4,035,529 | 7/1977 | Meisert et al. | 427/244 |
| 4,061,811 | 12/1977 | Takase et al. | 428/95 |
| 4,132,817 | 1/1979 | Tillotson | 427/244 |
| 4,171,395 | 10/1979 | Tillotson | 428/95 |
| 4,184,304 | 1/1980 | Merchant | 52/746 |
| 4,242,393 | 12/1980 | Leupen | 428/95 |

*Primary Examiner*—Marion McCamish

*Attorney, Agent, or Firm*—Earle R. Marden; H. William Petry

[57] ABSTRACT

A method of producing a carpet tile with a backing material that is magnetically attracted to a metal surface to hold the tile in position. The method produces a carpet tile in which the magnetic backing material is flush with the secondary backing to produce a tile of substantially constant thickness.

4 Claims, 2 Drawing Figures

MAGNETIC CARPET TILE

This invention relates to a method to produce a carpet tile which will be magnetically attracted to a metal surface but which can be readily moved or removed. Previously magnetic backings have been placed on the back of carpet tiles, but either completely covered the backing of the tile and could not readily be picked up or moved or were placed in strips on the bottom of the back of the tile providing an uneven tile backing which had soft spots therein resulting in an uneven walking surface.

Therefore, it is an object of the invention to produce a carpet tile with a magnetic backing which can be readily moved or removed and which has a substantially constant cross-section and a good lay flat quality.

Figure 1:
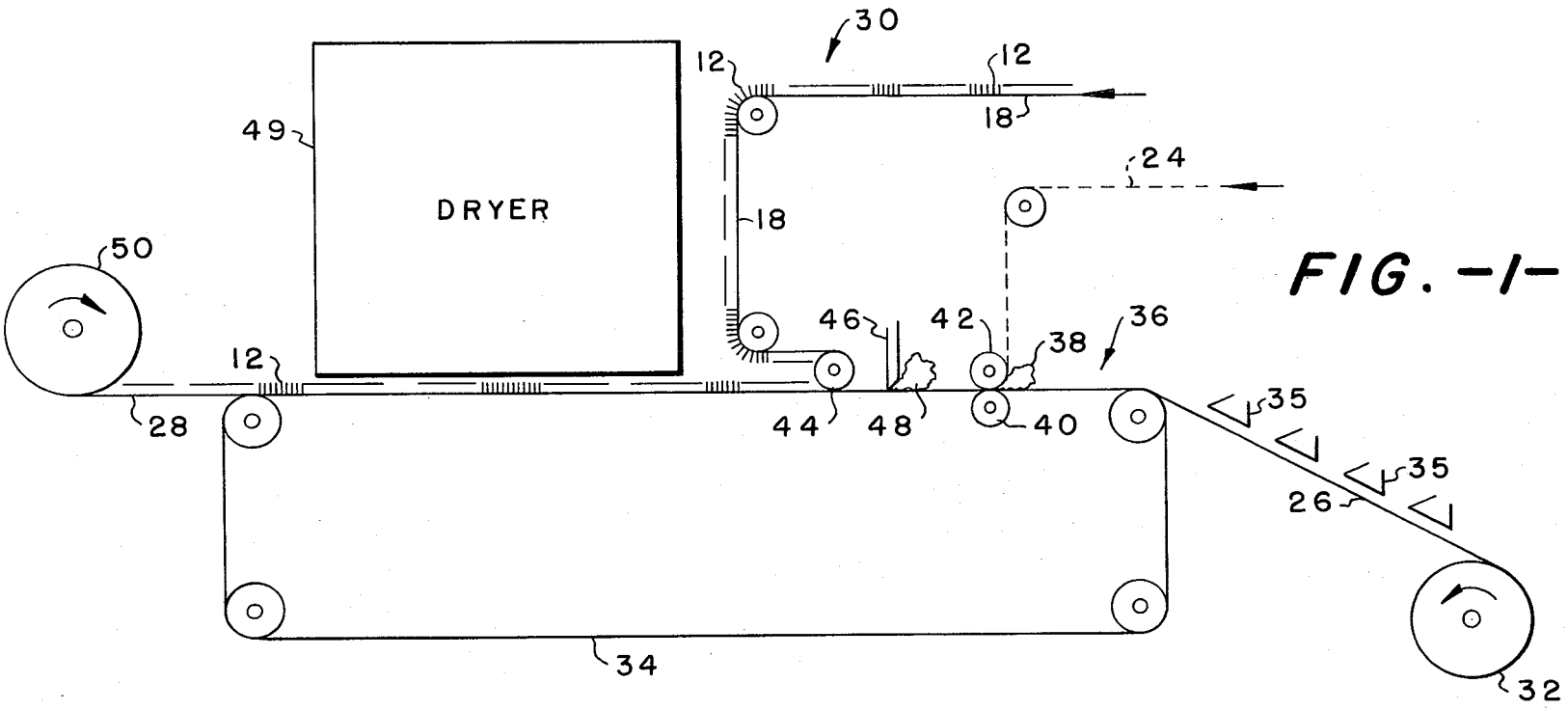
Figure 2:
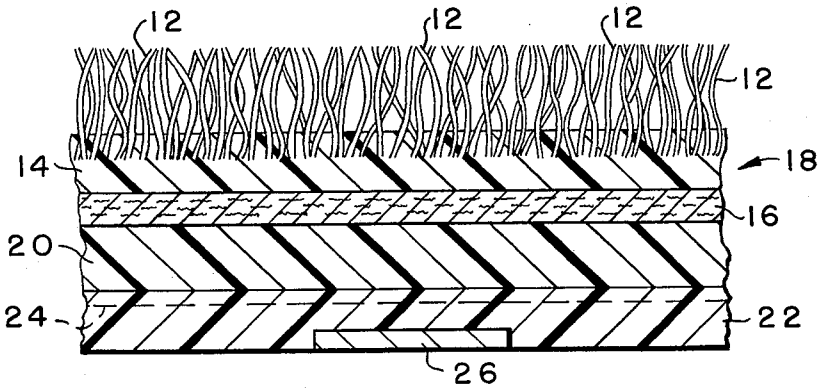

Other objects of the invention will become readily apparent as the specification proceeds to describe the invention with reference to the accompanying drawing, in which:

FIG. 1 is a schematic representation of the system of uniting the magnetic material to the primary backing of a carpet material, and FIG. 2 is a cross-sectional view of the carpet tile produced by the system shown in FIG. 1.

Looking first to FIG. 2, a bonded pile carpet tile is illustrated for the sake of discussion. The type of tile is not part of the invention since a tufted or woven pile carpet can be treated as shown in FIG. 1. The carpet tile 10 of FIG. 2 consists of a plurality of upright fibers 12 embedded and held in a suitable adhesive 14 of a suitable thermoplastic material such as polyvinyl chloride and laminated to a substrate of non-woven glass 16 to form the primary carpet 18. The secondary backing of the carpet tile 10 consists of two layers 20 and 22 of a suitable resilient material such as polyvinyl chloride. Embedded in layer 22 is a stabilizing layer of glass 24, either woven or non-woven and a strip of magnetic material 26. It should be noted that the magnetic strip 26 is embedded in the PVC layer 22 so that the thickness of the tile 10 is the same throughout and the width of the strip 26 is such that the extremities of the tile 10 can be lifted to move the tile. At the same time the selected width of the strip 26 is sufficient to provide the necessary holding power to the metallic surface upon which the tile is laid.

Looking now to FIG. 1, there is schematically represented a method of continuously producing the tile of FIG. 2. The tiles 10 are cut from a wide width of carpet 28 produced on the machine 30 of FIG. 1. The magnetic material 26 is supplied from a plurality of rolls 32 spaced across the machine 30 and consists, preferably, of a styrene, butylidene base thermoplastic material with magnetic particles embedded therein. The material 26 is supplied to an endless conveyor 34 and is conveyed, under infra red lamps 35 to soften and dry the strips 22, to the coating station 36 whereat the glass material is mated therewith and the PVC layer 22 is formed by the combination of the glass layer 24, supplied from a roll (not shown), a polyvinyl chloride plastisol 38 and the magnetic strip 26 on the conveyor 34 between the nip rolls 40 and 42. The layer 22 is then conveyed towards the roll 44 under a knife 46 which coats the polyvinyl chloride plastisol 48 thereon to form the layer 20. The conveyor 34 then conveys the resultant substrate to the roll 44 where it mates with the wide width of carpet 18, supplied from a roll (not shown). From the roll 44, the conveyer 34 conveys the laminated fabric or carpet 28 through a dryer 49 wherein the laminated structure is set or solidified. From the dryer 49 the resultant carpet 28 can be taken up on a suitable take-up roll 50 or cut into tiles 10 in line with the conveyor 34. If the carpet 28 is taken up on rolls 50 the carpet 28 can be transported off-line and cut into tiles at a remote location.

It can be seen that the above described method provides a continuous process which provides a carpet tile which has magnet attraction capabilities that does not hinder the moving or removal of such tile when placed upon a metallic surface. Furthermore, the tile has the same cross-sectional dimensions of a standard tile and can be used along with or in place of any such tile without disrupting the planar surface of the tiled area. The holding power of the magnetic backing can be controlled by the selection of the desired width to provide the necessary attraction to the surface that is being carpeted.

Although the preferred embodiment of the invention has been described in detail, it is contemplated that many changes may be made without departing from the scope or spirit of the invention, and I desire to be limited only by the claims.

I claim:

1. The method of making a carpet adapted to adhere to a metallic surface comprising the steps of: providing a supply of primary carpet material with an upstanding fiber surface, providing a secondary backing material, coating the secondary backing material with a polyvinyl chloride plastisol while simultaneously supplying a narrow strip of magnetic material into contact with the polyvinyl chloride plastisol, applying pressure to the secondary backing material, the polyvinyl chloride plastisol and the strip of magnetic material to embed the magnetic material into the polyvinyl chloride plastisol to form a secondary carpet backing, laminating the secondary carpet backing to the back of the primary carpet material, and applying heat to the laminated primary carpet material and secondary carpet backing to set the polyvinyl chloride plastisol.

2. The method of claim 1 wherein the strip of magnetic material is heated prior to being embedded into the polyvinyl chloride material.

3. The method of claim 2 wherein said primary carpet material is supplied in wide widths and said supply of magnetic material includes a plurality of rolls of magnetic material, said set laminated carpet being cut into tile squares after heating.

4. The product made by the process of claim 1.

* * * * *